US007141209B2

(12) United States Patent
Kaito et al.

(10) Patent No.: US 7,141,209 B2
(45) Date of Patent: Nov. 28, 2006

(54) METHOD FOR PRODUCING OXIDE DISPERSION STRENGTHENED FERRITIC STEEL TUBE

(75) Inventors: Takeji Kaito, Higashi-Ibaraki-gun (JP); Shigeharu Ukai, Higashi-Ibaraki-gun (JP); Satoshi Ohtsuka, Higashi-Ibaraki-gun (JP); Toshimi Kobayashi, Amagasaki (JP)

(73) Assignee: Japan Nuclear Cycle Development Institute, Ibaraki-Ken (JP)

( * ) Notice: Subject to any disclaimer, the term of this patent is extended or adjusted under 35 U.S.C. 154(b) by 89 days.

(21) Appl. No.: 10/669,685

(22) Filed: Sep. 25, 2003

(65) Prior Publication Data

US 2004/0071580 A1 Apr. 15, 2004

(30) Foreign Application Priority Data

Oct. 11, 2002 (JP) ..... 2002-298650

(51) Int. Cl.
*B22F 3/24* (2006.01)

(52) U.S. Cl. ..... 419/55; 419/28; 419/29

(58) Field of Classification Search ..... 419/28, 419/29, 19, 20

See application file for complete search history.

(56) References Cited

U.S. PATENT DOCUMENTS 4,075,010 A * 2/1978 Fischer ..... 75/235
4,479,833 A * 10/1984 Gessinger et al. ..... 419/48
4,732,622 A * 3/1988 Jones ..... 419/38
4,960,562 A * 10/1990 Okuda et al. ..... 376/416
4,963,200 A * 10/1990 Okuda et al. ..... 148/325
5,591,391 A * 1/1997 Igarashi et al. ..... 420/38
5,766,376 A * 6/1998 Hasegawa et al. ..... 148/328
5,851,318 A * 12/1998 Klower ..... 148/410
2004/0060621 A1* 4/2004 Fujitsuna et al. ..... 148/609
2005/0042127 A1* 2/2005 Ohtsuka et al. ..... 419/19

FOREIGN PATENT DOCUMENTS

EP 1408128 A1 * 4/2004
FR 2 731 231 9/1996
FR 2 821 858 9/2002
JP 8-225891 9/1996
JP 2002-266026 9/2002
JP 02004131816 A * 4/2004

OTHER PUBLICATIONS

Derwent Abstract, EP1408128A, Apr. 14, 2004.*

* cited by examiner

*Primary Examiner*—Daniel Jenkins
(74) *Attorney, Agent, or Firm*—Wenderoth, Lind & Ponack, L.L.P.

(57) ABSTRACT

There is provided a method for producing oxide dispersion strengthened ferritic steel tube by fabricating a raw tube by mixed sintering of a metal powder and an oxide powder and producing a tube of the desired shape by repeating cold rolling and heat treatment for a total of three times or more. The method comprises performing each of the intermediate heat treatments during the cold rolling by a two-step heat treatment consisting of a first step heat treatment of 1100° C. or lower and a second step heat treatment of 1100 to 1250° C. and higher than the first step temperature, and performing the final heat treatment at 1100° C. or higher.

2 Claims, 3 Drawing Sheets

One step heat treatment

Heat treatment temperature:1050℃

Heat treatment temperature:1100℃

Heat treatment temperature:1150℃

Heat treatment temperature:1200℃

Heat treatment temperature:1250℃

Two steps heat treatment

Heat treatment temperature:
1050℃+1100℃

Heat treatment temperature:
1050℃+1150℃

Heat treatment temperature:
1050℃+1250℃

METHOD FOR PRODUCING OXIDE DISPERSION STRENGTHENED FERRITIC STEEL TUBE

BACKGROUND OF THE INVENTION

The present invention relates to a method for producing oxide dispersion strengthened ferritic steel tube having an excellent neutron irradiation resistance and an excellent high temperature strength (creep rupture strength against internal pressure and the like), such as a fuel cladding tube, which is a core member of a fast reactor.

As a material having excellent neutron irradiation resistance and high temperature strength properties, there has been developed an oxide dispersion strengthened ferritic steel in which fine oxide particles were dispersed in a ferritic steel and various investigations and studies have been made to the tube fabrication work for fuel cladding tubes using the ferritic steel.

Since a fuel cladding tube required for severe dimensional accuracy has a small diameter and thin wall thickness, a method for producing the tube adopts tube fabrication work by cold rolling having high working degree.

However, an oxide dispersion strengthened ferritic steel cladding tube produced by cold rolling has a capillary crystal grain structure (fibrous structure) in which crystal grains were thinly lengthened in a direction of rolling. Thus, there was a serious problem that ductility and creep rupture strength against internal pressure in a circumferential direction of a tube (that is, a direction perpendicular to a direction of rolling), which is significant as a component of a fast reactor are low. Further, there was a problem that the oxide dispersion strengthened ferritic steel is hardened by repeating cold rolling, resulting in substantial difficulty in the cold rolling and also occurrence of cracks.

To improve these problems, an attempt has been made to sufficiently perform the heat treatment after cold rolling to coarsen the crystal grains and generate a recrystallization structure in which the crystal grains are grown in the circumferential direction of the tube. For example, Japanese Patent Laid-open Specification No. 8-225891/1996 discloses compositions which can generate a recrystallization structure by specifying the content of $Y_2O_3$ in an oxide dispersion strengthened ferritic steel and the amount of excessive oxygen.

Further to prevent the hardening of the steel by repeating cold rolling, Japanese Patent Application No. 2001-062913, filed Mar. 7, 2001, for example, suggests a method for producing an oxide dispersion strengthened ferritic steel tube, in which a tube of the desired shape is produced by repeating cold rolling and heat treatment three times or more. In this method, an intermediate heat treatment during the cold rolling is performed at a temperature lower than 1100° C. to recover and soften the strain and dislocation generated by working without generating a recrystallization structure, so that a cold rolling in the next step can be efficiently performed, and the final heat treatment is performed at 1100° C. or higher to generate a recrystallization structure.

However, even if the compositions of the above-mentioned oxide dispersion strengthened ferritic steel is adopted and the intermediate heat treatment during the cold rolling is performed, there still were the following problems.

That is, when the intermediate heat treatment is performed without generating a recrystallization structure, there was a necessity to perform the real and substantial intermediate heat treatment after cutting a specimen out of an end of a tube after each cold rolling and checking the presence or absence of a recrystallization structure and the softening degree in the specimen by a previous test to set the most suitable condition of the intermediate heat treatment.

Further, when the intermediate heat treatment was performed at lower than 1100° C., the tube is not sufficiently softened but only to a limited hardness of about 400 Hv. Thus, although a cold rolling in the next step is possible, cracking can generate and it has been impossible to perform a stable tube manufacturing working.

SUMMARY OF THE INVENTION

Accordingly, an object of the present invention is to provide a method for producing a tube constituted of an oxide dispersion strengthened ferritic steel, which can prevent the generation of a recrystallization structure in the intermediate heat treatment during the cold rolling, can sufficiently soften the tube and efficiently perform cold rolling in the next step by performing the intermediate heat treatment at a comparatively high temperature, and can prevent the generation of cracking in the step of cold rolling.

The present inventors have found that while working for producing a tube using an oxide dispersion strengthened ferritic steel, the steel can be sufficiently softened without generating a recrystallization structure and can easily, efficiently perform the subsequent cold rolling by performing each intermediate heat treatment in two steps during a plurality of cold rolling, setting a treatment temperature, which does not generate a recrystallization structure in the first step heat treatment, and performing heat treatment in the second step heat treatment at higher temperature than in the first step, whereby completing the present invention.

Thus, there is provided a method for producing oxide dispersion strengthened ferritic steel tube by fabricating a raw tube by mixed sintering of a metal powder and an oxide powder, and producing a tube of the desired shape by repeating cold rolling and heat treatment for a total of three times or more, wherein the method comprises: performing each of the intermediate heat treatments during the cold rolling by a two-step heat treatment consisting of a first step heat treatment of 1100° C. or lower and a second step heat treatment of 1100 to 1250° C. and higher than the first step temperature, and performing the final heat treatment at 1100° C. or higher.

The oxide dispersion strengthened ferritic steel used in the present invention preferably contains 11 to 15% by wight of Cr, 0.1 to 1% by weight of Ti, and 0.15 to 0.35% by weight of $Y_2O_3$.

PREFERRED EMBODIMENTS OF THE INVENTION

Figure 1:
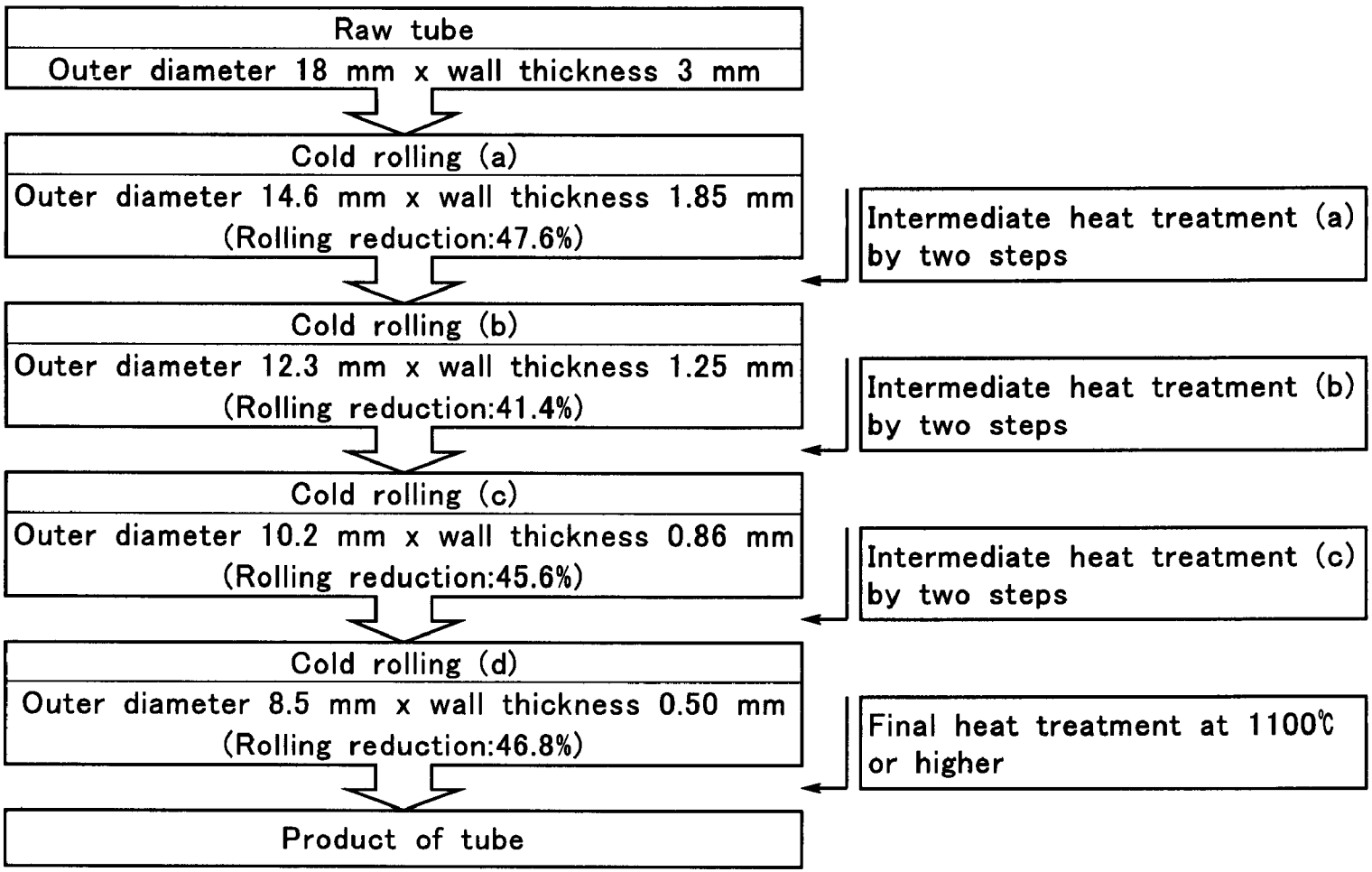
FIG. 1 is a diagram which shows an example of a tube production process according to the present invention.

Referring to FIG. 1 which shows an example of a production step of a cladding tube of the present invention using an oxide dispersion strengthened ferritic steel. In order to uniformly disperse the fine oxide particles, a tube is produced by first fabricating a raw tube by mixed sintering of a metal powder and an oxide powder, and performing cold rolling four times, intermediate heat treatment during the cold rolling three times and final heat treatment to obtain a tube formed into the desired shape.

The raw tube is produced, for example, by sufficiently crushing and mixing a metal powder and an oxide powder of the predetermined composition by means of a so-called mechanical alloying technique which uses, for example, a ball mill and the like. Then, the resulting powder is sealed inside a soft steel capsule or the like, and monolithically sintered by means of hot extrusion to obtain a raw tube to be worked by cold rolling. If necessary, the resulting product is further subjected to heating and annealing to obtain a raw tube that is then subjected to cold rolling. The fabrication to this step can be performed in accordance with a technology known in the art.

For the cold rolling of a raw tube, there is preferably used a Pilger rolling machine or a HPTR rolling machine. The rolling reduction (reduction in area) on cold rolling must be 30% or more, preferably 40% or more. In this case, the rolling reduction in cold rolling signifies the total rolling reduction obtained as a result from starting rolling on the raw tube or from the softened state after annealing the raw tube to the intermediate heat treatment (annealing) or the final heat treatment (annealing) applied for the next softening; hence, a rolling with a rolling reduction of 30% or more may be performed in a single pass, or a plurality of passes, i.e., two passes or three passes, to obtain a rolling reduction of 30% or more in total.

In the present invention, each of the intermediate heat treatments (that is, the intermediate heat treatments (a) to (c) in the example of FIG. 1) during cold rolling working is composed of, and employed by, a two-step heat treatment.

The first step heat treatment in this two-step heat treatment is performed, so as not to generate a recrystallization structure, by setting a treating temperature at 1100° C. or lower. Thus, even the second step heat treatment at higher temperature is ensured to allow no generation of recrystallization, and to sufficiently release the working strain energy introduced by the cold rolling. A recrystallization is partially generated at the second step heat treatment temperature of higher than 1100° C., for example 1150° C., and when the second step heat temperature is 1200° C. or higher, the structure of the tube resulted in a fully recrystallized structure as shown by the microphotographs in FIG. 3.

The second step heat treatment in the two-step heat treatment is performed at a treatment temperature of 1100 to 1250° C., higher than the temperature in the first step heat treatment. When 1100° C. is adopted as the heat treatment temperature in the second step, the first step heat treatment is performed at the temperature lower than 1100° C., for example at 1050° C. By performing the second step heat treatment at 1100 to 1250° C., higher than the first step, the softening can be sufficiently performed without generating recrystallization. In other words, the first step heat treatment fully recovers strain to release the working strain energy and, therefore, a recrystallization structure is not generated even if the second step heat treatment is conducted at a higher temperature than that of the first step heat treatment. Further, since the second step heat treatment softens the steel, the working by cold rolling in the subsequent step can easily be performed and the generation of cracking can be prevented efficiently and reliably. By contrast, the heat treatment at a temperature higher than 1250° C., generates coarsening of dispersed particles, and is undesirable from a viewpoint of an industrial heat treatment temperature.

The final heat treatment is performed at a heating temperature of 1100° C. or higher in order to obtain a recrystallization structure. At a temperature lower than 1100° C., a sufficient recrystallization structure cannot be formed, and there is fear that the anisotropy of the strength in the direction of rolling and in the circumferential direction perpendicular to the direction of rolling cannot be reduced. On the other hand, when the final heat treatment is performed at a temperature higher than 1250° C., even if the anisotropy of the strength can be reduced, the creep strength may be lowered; hence, the final heat treatment is preferably effected at a temperature of 1250° C. or lower.

Concerning the heating time of the intermediate heat treatment and final heat treatment described above, the object may sufficiently be achieved by holding the temperature for 10 minutes or longer and for about 2 hours.

The conditions for the above-mentioned rolling and heat treatment in the present invention are particularly effective in the case where rolling and the intermediate and final heat treatment are respectively repeated for three times or more in total.

The tube according to the present invention is produced from a ferritic steel and being strengthened by dispersing an oxide, a raw material of which being obtained by mixed sintering of an alloy powder and an oxide powder. As fine oxide particles to be dispersed in the alloy, usable are those of MgO, $Al_2O_3$, $MgAl_2O_4$, $ThO_2$, $TiO_2$, $ZrO_2$ and the like, from which one or two types or more thereof are added. In case of improving the high temperature strength of the tube by dispersing the fine particles of any types of the oxides, the application of the invention of the present invention exhibits a remarkable effect in increasing the strength or in reducing the anisotropy of the strength.

A tube in which the effect of the present invention is most exhibited is an oxide dispersion strengthened ferritic steel tube, which contains 11 to 15% by weight of Cr, 0.1 to 1% by weight of Ti, 0.15 to 0.35% by weight of $Y_2O_3$. The steel may contain, in addition to the components described above, other alloy components that are commonly added in a ferritic steel.

In this case, if the Cr content should be less than 11% by weight, the oxidation resistance and corrosion resistance become insufficient, and if the Cr content should exceed 15% by weight, embrittlement due to neutron irradiation tends to occur more easily on the steel. Hence, the Cr content of the steel is preferably set in a range of from 11 to 15% by weight. Ti functions to finely divide the particles of the oxide such as $Y_2O_3$ and the like, and it is preferably added in a range of from 0.1 to 1% by weight. An addition of Ti at an amount of less than 0.1% by weight has small effect, and the effect becomes saturated if the addition of Ti exceeds 1% by weight.

$Y_2O_3$ is added at an amount of from 0.15 to 0.35% by weight as an oxide to be dispersed. $Y_2O_3$ can easily and minutely be dispersed, and is an oxide extremely effective for improving the high temperature strength. If the content thereof should be less than 0.15% by weight, it is apt to generate a recrystallization structure in the intermediate heat treatment during rolling. However, if the content thereof should exceed 0.35% by weight, the treatment temperature necessary for obtaining the recrystallization structure in the final heat treatment becomes higher, and difficulties are encountered in working. Thus, the content of $Y_2O_3$ is preferably set in a range of from 0.15 to 0.35% by weight.

Test Example

Figure 2:
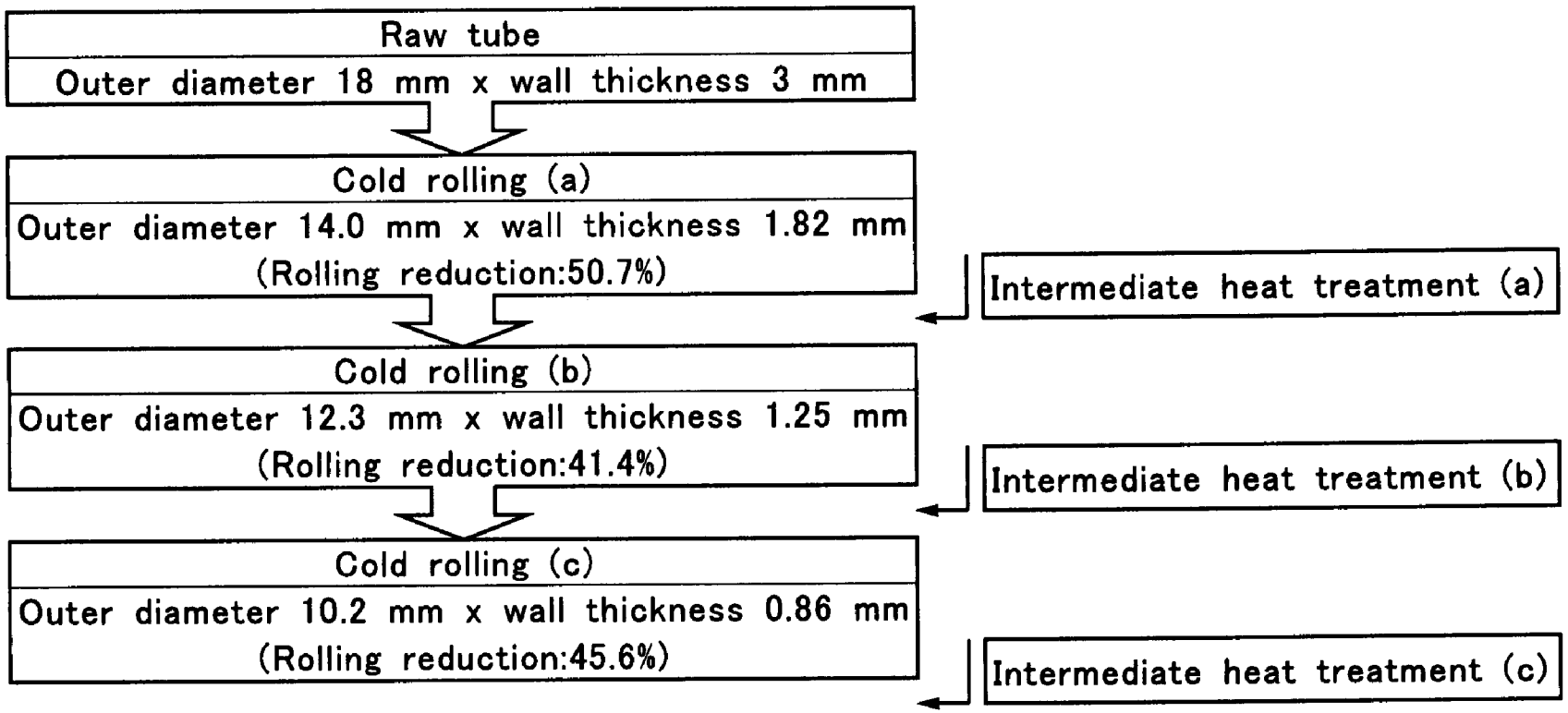
FIG. 2 is a diagram of an intermediate heat treatment test in a tube production process according to the present invention.

An intermediate heat treatment test in the production process of a tube of an oxide dispersion strengthened ferritic steel whose basic composition is 0.03 C-12.0 Cr-2 W-0.26 Ti-0.23 $Y_2O_3$ was performed by use of the steps in FIG. 2. A powder of $Y_2O_3$ was mixed with a ferro-alloy powder, and the resulting mixture was crushed and mixed in an attritor ball mill under gaseous argon atmosphere. The resulting powder was sealed in a soft steel capsule, after heating the powder to 1175° C., an alloy rod of about 25 mm in outer diameter was fabricated at an extrusion ratio of about 7.8. Then, this alloy rod was hot-forged at 1150° C. to be reduced to 23 mm in outer diameter, and was heat treated at 1200° C. for a duration of 1 hour. After that a raw tube for use in cold rolling having outer diameter of 18 mm and wall thickness of 3 mm was fabricated by machining. The chemical composition of the raw tube thus fabricated is given in Table 1.

TABLE 1

| Chemical composition of raw tube (% by weight) | | | | | | |
|---|---|---|---|---|---|---|
| C | Si | Mn | P | S | Ni | Cr |
| 0.04 | 0.045 | 0.07 | 0.006 | 0.003 | 0.04 | 11.59 |
| W | Ti | $Y_2O_3$ | Ex. O | N | Ar | |
| 1.91 | 0.27 | 0.229 | 0.066 | 0.009 | 0.006 | |

Note)
The balance is Fe and impurities.
Ex. O shows excessive oxygen.

An intermediate heat treatment test was performed using these raw tubes by the steps shown in FIG. 2. Cold rolling was performed by using a Pilger rolling machine, and working was performed at a rolling reduction of about 50% by one pass in cold rolling (a).

In intermediate heat treatment (a) after the cold rolling (a), only one step heat treatment was performed at five types of temperatures of 1050° C., 1100° C., 1150° C., 1200° C., and 1250° C.

In intermediate heat treatment (b) after the cold rolling (b), in addition to the one step heat treatment at the same five types of temperatures as in the intermediate heat treatment (a), two-step heat treatment at two types of temperatures of 1050° C.+1100° C. and at 1050° C.+1150° C. was performed.

In intermediate heat treatment (c) after the cold rolling (c), in addition to the same heat treatment as in the intermediate heat treatment (b), two-step heat treatment at 1050° C.+1250° C. was performed.

Figure 3:
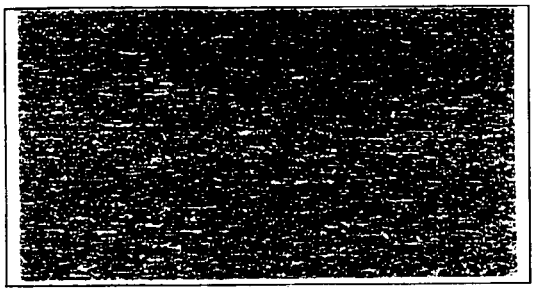
FIG. 3 are microphotographic views (×100) which show longitudinal cross-sections of tubes used in intermediate heat treatment tests.
Figure 3:
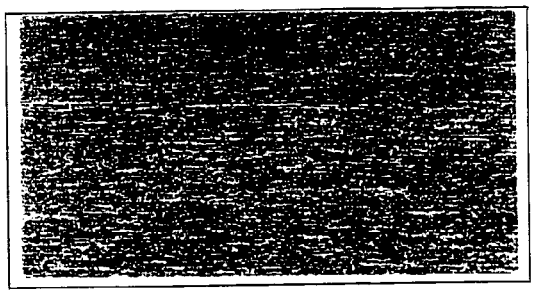
Figure 3:
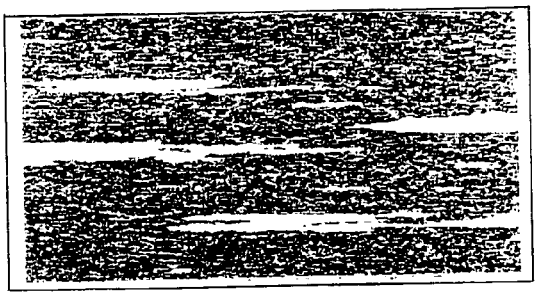
Figure 3:
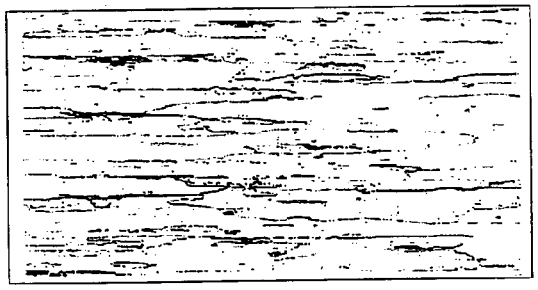
Figure 3:
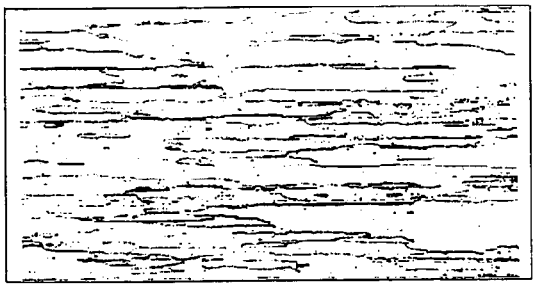
Figure 3:
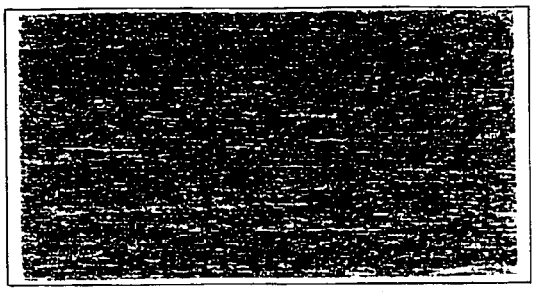
Figure 3:
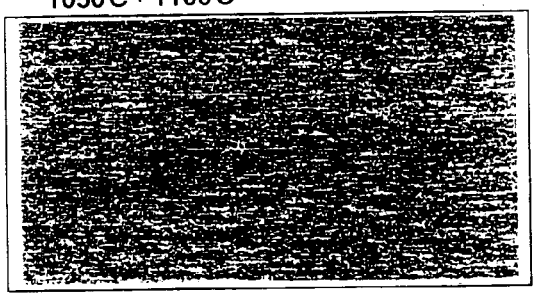
Figure 3:
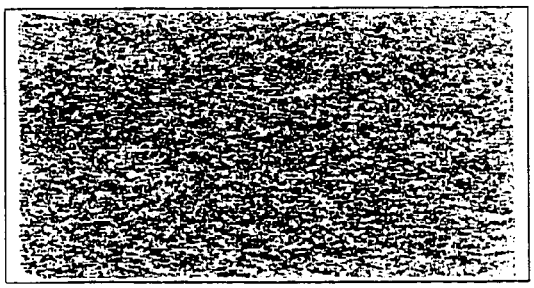

In these intermediate heat treatment (a) to (c), the holding times at a desired temperature were all set to 30 minutes. Specimens were cut out of an end portion of tubes subjected to the respective intermediate heat treatment, and their hardness of the specimens was measured and their microscopic structures of longitudinal cross-sections were observed. The obtained test results are shown in Table 2. Further, a microscopic structure subjected to the intermediate heat treatment (c) is shown in FIG. 3.

TABLE 2

Test Results of Intermediate Heat Treatment

| | Heat treatment Conditions | Hardness (Hv) | Recrystallization conditions |
|---|---|---|---|
| Cold rolling (a) | — | 431 | — |
| Intermediate | 1050° C. × 30 min | 394 | Non |
| Heat treatment (a) | 1100° C. × 30 min | 378 | Partial recrystallization |
| | 1150° C. × 30 min | 344 | Recrystallization |
| | 1200° C. × 30 min | 343 | Recrystallization |
| | 1250° C. × 30 min | 343 | Recrystallization |
| Cold rolling (b) | — | 436 | — |
| Intermediate | 1050° C. × 30 min | 419 | Non |
| Heat treatment (b) | 1100° C. × 30 min | 406 | Non |
| | 1150° C. × 30 min | 375 | Partial recrystallization |
| | 1200° C. × 30 min | 326 | Recrystallization |
| | 1250° C. × 30 min | 313 | Recrystallization |
| | 1050° C. × 30 min + 1100° C. × 30 min | 407 | Non |
| | 1050° C. × 30 min + 1150° C. × 30 min | 399 | Non |
| Cold rolling (c) | — | 449 | — |
| Intermediate | 1050° C. × 30 min | 429 | Non |
| Heat treatment (c) | 1100° C. × 30 min | 418 | Non |
| | 1150° C. × 30 min | 392 | Partial recrystallization |
| | 1200° C. × 30 min | 310 | Recrystallization |
| | 1250° C. × 30 min | 326 | Recrystallization |
| | 1050° C. × 30 min + 1100° C. × 30 min | 419 | Non |
| | 1050° C. × 30 min + 1150° C. × 30 min | 407 | Non |
| | 1050° C. × 30 min + 1250° C. × 30 min | 378 | Non |

As can be understood from these results, when cold rolling is repeated, the tube becomes hard and the level of softening by heat treatment is decreased. In the intermediate heat treatments (b) and (c), when the heat treatment is performed by one step at a heat treatment temperature of less than 1100° C., sufficient softening for, for example, hardness of 400 Hv or less cannot be obtained. To obtain hardness of 400 Hv or less, the temperature of one step heat treatment must be set to 1150° C. or higher. In this case, however, recrystallization is generated.

On the contrary, when intermediate heat treatment consisting of the two-step heat treatment according to the present invention is performed, the working strain energy introduced in the cold rolling can be released by the first step heat treatment at 1050° C., whereby, even if the second step heat treatment is performed at high temperature of for example 1250° C., a recrystallization structure is not generated and the hardness of a tube can sufficiently be softened to 400 Hv or less.

According to the method for producing an oxide dispersion strengthened ferritic steel tube of the present invention, intermediate heat treatment during cold rolling is performed by the two-step heat treatment, and the first step heat treatment is performed at 1100° C. or lower, and the second step heat treatment is performed at 1100 to 1250° C. and higher than in the first step heat treatment. Thus, a recrystallization structure is not generated during the intermediate heat treatment and sufficient softening of a tube can be performed, so that the subsequent cold rolling can be performed easily and effectively. Therefore, the reliability of cold rolling can be improved.

As a result, the number of occurrence of cracks, which have been generated in the conventional production steps, can be suppressed and the yield of the products is improved, thereby permitting the reduction in production costs.

Furthermore, in a conventional working for producing a tube, a specimen is cut out of a tube after every cold rolling and the presence or absence of a recrystallization structure and a level of softening are checked in previous test. Then after the most suitable intermediate heat treatment conditions are set, actual heat treatment was required. By contrast, according to the present invention in which the intermediate heat treatment is composed of the two-step heat treatment, actual heat treatment can directly be performed without performing the previous test.

What is claimed is:

1. A method for producing oxide dispersion strengthened ferritic steel tube by fabricating a raw tube by mixed sintering of a metal powder and an oxide powder; and producing a tube of the desired shape by repeating cold rolling and heat treatment for a total of three times or more, the method comprising:

performing each intermediate heat treatment during the cold rolling by a two-step heat treatment consisting of a first step heat treatment of 1100° C. or lower and a second step heat treatment of 1100 to 1250° C. and at least 50° C. higher than the first step temperature, and performing a final heat treatment at 1100° C. or higher, wherein each of the steps of each of the two-step intermediate heat treatments, and the final heat treatment are performed by holding the temperature for 10 minutes or longer up to about 2 hours.

2. A method for producing oxide dispersion strengthened ferritic steel tube according to claim 1, wherein said oxide dispersion strengthened ferritic steel contains 11 to 15% by weight of Cr, 0.1 to 1% by weight of Ti, and 0.15 to 0.35% by weight of $Y_2O_3$.

* * * * *